US011376653B2

(12) United States Patent
Soloveykin et al.

(10) Patent No.: US 11,376,653 B2
(45) Date of Patent: Jul. 5, 2022

(54) FEEDER SYSTEM

(71) Applicant: Foseco International Limited, Barlborough Links (GB)

(72) Inventors: Anton Viktorovich Soloveykin, Bashkortostan (RU); Alexey Nikolaevich Panov, Saint-Petersburg (RU)

(73) Assignee: Foseco International Limited, Derbyshire (GB)

( * ) Notice: Subject to any disclaimer, the term of this patent is extended or adjusted under 35 U.S.C. 154(b) by 0 days.

(21) Appl. No.: 17/213,713

(22) Filed: Mar. 26, 2021

(65) Prior Publication Data

US 2021/0299742 A1 Sep. 30, 2021

(30) Foreign Application Priority Data

Mar. 26, 2020 (RU) ..... RU2020112272

(51) Int. Cl.
*B22C 9/08* (2006.01)

(52) U.S. Cl.
CPC ..... *B22C 9/088* (2013.01); *B22C 9/084* (2013.01)

(58) Field of Classification Search
CPC ..... B22C 9/08; B22C 9/084; B22C 9/088
See application file for complete search history.

(56) References Cited

U.S. PATENT DOCUMENTS 4,719,958 A * 1/1988 Schopp ..... B22C 9/088 164/29
2017/0014896 A1* 1/2017 Schaefer ..... B22C 9/088

FOREIGN PATENT DOCUMENTS

CN 205967293 U * 2/2017
GB 2550944 A * 12/2017 ..... B22C 9/084
GB 2567139 A * 4/2019 ..... B22C 9/088

* cited by examiner

*Primary Examiner* — Kevin P Kerns
*Assistant Examiner* — Steven S Ha
(74) *Attorney, Agent, or Firm* — Merchant & Gould P.C.

(57) ABSTRACT

The present invention relates to a feeder system for use in metal casting operations utilising casting moulds, and to feeder sleeves and breaker cores for use in the feeder system. There is provided a feeder system for metal casting, the feeder system comprising a feeder sleeve mounted on a breaker core, the feeder sleeve having a first end and an opposite second end, a longitudinal axis extending between the first and second ends, and a continuous sidewall extending generally around the longitudinal axis between the first and second ends, the sidewall defining a cavity for receiving molten metal during casting, and the breaker core defining an open bore therethrough for connecting the cavity to the casting, wherein the first end of the feeder sleeve comprises a base portion which is mounted on the breaker core, and the second end of the feeder sleeve comprises a planar roof portion and a curved or chamfered portion extending around the periphery of the roof portion, for connecting the sidewall and the roof portion.

14 Claims, 6 Drawing Sheets

FEEDER SYSTEM

CROSS-REFERENCE TO RELATED APPLICATIONS

This application claims the benefit of priority to Russian Patent Application No. 2020112272, filed on Mar. 26, 2020, which application is incorporated herein by reference.

The present invention relates to a feeder system for use in metal casting operations utilising casting moulds, and feeder sleeves and breaker cores for use in the feeder system.

BACKGROUND

In a typical casting process, molten metal is poured into a pre-formed mould cavity which defines the shape of the casting. The casting mould is usually produced by compacting a mixture of sand and binder around a first mould pattern inside a flask, allowing the sand mixture to set and harden, then removing the pattern to leave one half of the moulding cavity. This process is repeated with a second mould pattern which defines the second half of the moulding cavity, and the two halves of the mould (referred to as the cope and drag) are then assembled together to create an entire mould defining the complete mould cavity therein. Although moulds formed in this way may be used multiple times, the mould may eventually fail or the pattern shape may be eroded, at which point the mould is destroyed and the sand recovered and reconditioned for re-use in new moulds. However, with this type of mould, it is difficult to recover the sand and separate it from the binder material at the end of the mould's useful life.

In an alternative casting process, known as the vacuum mould casting process or "V-process", the mould is created using dry sand which does not contain any binder and the shape of the mould is maintained due to the forces exerted by a vacuum. In the V-process, the mould pattern comprises tiny holes to enable vacuum suction. A first plastic film is drawn over the mould pattern and adhered to the mould pattern by suction. A special flask also equipped with a suction system is placed around the mould pattern and filled with dry sand, which is then compacted. The top side of the flask is covered by a second plastic sealing film and suction is applied through the flask, which causes the first and second plastic films (at the bottom and top, respectively) to adhere to the moulding sand, sealing it within the flask. The vacuum through the pattern is then turned off and the pattern is released, while the vacuum through the flask is continuously applied to keep the sand firm and maintain the shape of the moulding cavity left by the pattern. A cope and drag formed in this way are assembled to form a complete mould cavity, while still applying suction to maintain the shape of the sand, and molten metal is poured into the cavity. Once the metal casting has cooled and solidified, the moulding sand can easily be restored to its original, loose state and recovered for future use by simply turning off the vacuum.

In most metal casting processes, the metal will shrink as it solidifies, resulting in shrinkage cavities which in turn result in unacceptable imperfections in the final casting. This is a well-known problem in the casting industry and is addressed by the use of feeder sleeves or risers which are integrated into the mould. Each feeder sleeve provides an additional (usually enclosed) volume or cavity which is in communication with the mould cavity, so that molten metal enters into the feeder sleeve from the mould cavity during casting. During solidification of the casting, molten metal within the feeder sleeve flows back into the mould cavity to compensate for the shrinkage of the casting. After solidification of the casting and removal of the moulding sand, unwanted residual metal from within the feeder sleeve cavity remains attached to the casting and must be removed. In order to facilitate removal of the residual metal, the feeder sleeve cavity may be tapered towards its base (i.e. the end of the feeder sleeve which will be closest to the mould cavity), in a design commonly referred to as a neck down sleeve. When a sharp blow is applied to the residual metal it separates at the weakest point, near to the mould (a process commonly known as "knock off"). A small footprint on the casting is also desirable to allow the positioning of feeder sleeves in areas of the casting where access may be restricted by adjacent features.

Although feeder sleeves may be applied directly onto the surface of the casting mould cavity, they are often used in conjunction with a breaker core. A conventional breaker core is simply a plate or disc of refractory material (typically a resin-bonded sand core, a ceramic core or a core of feeder sleeve material) with a hole therethrough, which sits between the mould cavity and the feeder sleeve. The diameter of the hole through the breaker core is designed to be smaller than the diameter of the interior cavity of the feeder sleeve (which need not necessarily be tapered) so that knock off occurs at the breaker core close to the casting surface. More recently developed breaker cores (such as those described in Foseco PCT application nos. WO2016/034872, WO2017/025702 and WO2016/166497) may be in metal tubular form, with a bore therethrough.

In the V-process, the feeders are placed on a boss or pin on the mould pattern before the first plastic film is applied to the pattern. Generally, the feeders are placed on the mould pattern as a pre-formed system, with the breaker core attached to the base of the feeder sleeve, e.g. by adhesive. However, bridges of film may sometimes be created between adjacent feeder sleeves. Moreover, any sharp edges at the top of the feeder sleeves may potentially tear the plastic film when it is drawn over the pattern and feeder sleeves.

The present invention has been devised with these issues in mind.

SUMMARY

According to a first aspect of the invention, there is provided a feeder system for metal casting, the feeder system comprising a feeder sleeve mounted on a breaker core. The feeder sleeve has a first end and an opposite second end, a longitudinal axis extending between the first and second ends, and a continuous sidewall extending generally around the longitudinal axis between the first and second ends. The sidewall of the feeder sleeve defines a cavity for receiving molten metal during casting, and the breaker core defines an open bore therethrough for connecting the cavity to the casting. The first end of the feeder sleeve comprises a base portion which is mounted on the breaker core. The second end of the feeder sleeve comprises a planar roof portion and a curved or chamfered portion extending around the periphery of the roof portion, for connecting the sidewall and the roof portion of the feeder sleeve.

DETAILED DESCRIPTION

Conventional feeder sleeves tend to be squared off at the top, with a substantially 90° corner between the sidewall and the roof portion of the sleeve, resulting in a relatively sharp edge at the top of the sleeve. In the feeder system of the invention, the curved or chamfered portion ameliorates the sharp edge at the top of conventional feeder sleeves and reduces the risk of tearing the plastic film when it is drawn over the pattern during formation of a V-process mould. In embodiments where the feeder sleeve comprises a chamfered portion, this is achieved by effectively creating two edges between the sidewall and the roof portion of the sleeve, each with a corner angle significantly lower than 90°, which are less sharp than a conventional single edge having a corner angle of 90°. In embodiments where the feeder sleeve comprises a curved portion, any hard edges between the sidewall and the roof portion of the sleeve are eliminated entirely.

In embodiments, the sidewall of the feeder sleeve is cylindrical. The cross-sectional shape of the cylinder may be generally circular, oval or obround. In some embodiments, the diameter of the cylinder is generally constant from the first end to the second end. In other embodiments, the diameter at the first end of the feeder sleeve may be larger than the diameter at the second end, or vice versa. In some embodiments, the sidewall of the feeder sleeve is generally cylindrical with a frustoconical portion located towards the first end of the feeder sleeve, which tapers towards the breaker core.

In embodiments, the base portion at the first end of the feeder sleeve extends substantially perpendicular to the longitudinal axis of the feeder sleeve (i.e. at an angle of about 90° relative to the longitudinal axis of the feeder sleeve). Alternatively, the base portion may be inclined at an angle relative to the longitudinal axis of the feeder sleeve, such that the sidewall on one side of the feeder sleeve is shorter than the sidewall on the opposite side of the feeder sleeve. In embodiments, the base portion extends at an inclination angle of at least 30°, 35°, 40°, 50°, 60°, 70°, 80° or 85° relative to the longitudinal axis of the feeder sleeve. In embodiments, the base portion extends at an inclination angle of no more than 88°, 85°, 80°, 70°, 60°, 50°, 40° or 35° relative to the longitudinal axis of the feeder sleeve. In embodiments, the base portion extends at an inclination angle of 30-88°, 40-85° or 50-80° relative to the longitudinal axis of the feeder sleeve. It will be understood that the breaker core on which the feeder sleeve is mounted will extend in the same direction or at the same inclination angle as the base portion of the feeder sleeve. An inclined base portion and breaker core may be desirable in cases where the feeder system is to be located on an angled section of the casting.

In embodiments, the breaker core is a conventional plate- or disc-shaped breaker core. Alternatively, the breaker core may comprise a planar base defining a bore therethrough, and an annular raised sidewall extending around the circumference of the base. In embodiments, the raised sidewall has a lower surface, which is attached to or integrally formed with the planar base, and an upper surface opposite to the lower surface, with an inner edge and an oppositely disposed outer edge extending between the upper and lower surfaces. In embodiments, the height of the raised sidewall is at least 1%, 2%, 5%, 10% or 15% of the maximum height of the feeder sleeve, where the height of the raised sidewall is measured from the lower surface to the upper surface and the maximum height of the feeder sleeve is measured from the first end to the second end. In embodiments, the height of the raised sidewall is no more than 15%, 10%, 5%, 2% or 1% of the maximum height of the feeder sleeve. In embodiments, the height of the raised sidewall is 1-15%, 2-10% or 5-10% of the maximum height of the feeder sleeve. It will be understood that, in embodiments where the base portion of the feeder sleeve is inclined relative to the longitudinal axis, the maximum height of the feeder sleeve is the maximum distance between the first and second ends, i.e. where the height of the sidewall of the feeder sleeve is greatest.

Providing a breaker core with a raised sidewall enables the feeder system to be applied to the mould pattern in two parts, when desired. In this two-part application process, the breaker core is located on the mould pattern first, then the first plastic film is drawn over the mould pattern and breaker core, and then the feeder sleeve is assembled with the breaker core over the plastic film. This prevents the plastic film from bridging between the feeder sleeves, because the film is not drawn over the sleeves themselves. During casting, the plastic film between the breaker core and feeder sleeve is easily burned away by the molten metal and does not interfere with the casting.

In embodiments, the breaker core further comprises a ridge or boss projecting from the upper surface of the raised sidewall in a direction away from the planar base. The boss allows the feeder sleeve to be aligned correctly and mounted securely on the breaker core during assembly of the feeder system. In embodiments, the boss extends completely or partially around the circumference of the inner edge of the raised sidewall. The boss may extend around at least 5%, 10%, 20%, 30%, 40%, 50%, 60%, 70%, 80% or 90% of the circumference of the inner edge. The boss may extend around no more than 100%, 90%, 80%, 70%, 60%, 50%, 40%, 30%, 20% or 10% of the circumference of the inner edge. In embodiments, the boss extends around 25-100% or 25-50% of the circumference of the inner edge.

It will be understood that the first end of the feeder sleeve is appropriately configured to be mounted onto the breaker core during assembly of the feeder system. For example, in embodiments where the breaker core comprises a raised sidewall and a boss extending around the inner edge of the raised sidewall, the sidewall of the feeder sleeve may have a thickness which corresponds to the remaining width of the upper surface of the raised sidewall excluding the width of the boss, so that the sidewall of the feeder sleeve fits snugly against the boss. Alternatively, the sidewall at the first end of the feeder sleeve may comprise a cut-out or groove configured to receive the boss on the breaker core.

In embodiments, the planar roof portion is centrally located at the second end. Preferably, the roof portion extends perpendicular to the longitudinal axis of the feeder sleeve.

In general, the shape of the roof portion may correspond to the cross-sectional shape of the sidewall of the feeder sleeve. For example, in embodiments where the sidewall of the feeder sleeve has a generally circular cross-sectional shape, the roof portion may be generally circular, or in embodiments where the sidewall has a generally obround cross-sectional shape, the roof portion may be generally obround. In embodiments, the roof portion has a minimum diameter which is at least 25%, 30%, 40%, 50%, 60%, 70%, 80% or 85% of the minimum diameter of the sidewall of the feeder sleeve. In embodiments, the roof portion has a minimum diameter which is no more than 90%, 85%, 80%, 70%, 60%, 50%, 40% or 30% of the minimum diameter of the sidewall. In embodiments, the roof portion has a minimum diameter which is 25-90%, 30-80% or 40-70% of the minimum diameter of the sidewall of the feeder sleeve.

In embodiments, the roof portion of the feeder sleeve comprises an open bore therethrough. The bore may be located in the centre of the roof portion. Alternatively, the bore may be offset from the centre of the roof portion. The shape of the bore in the roof section may correspond to the shape of the roof portion. For example, where the roof portion is circular, the bore may also be circular, or where the roof portion is obround, the bore may also be obround. However, the shape of the bore may not necessarily correspond to the shape of the roof portion (for example, where the roof portion is obround, the bore may be circular). The bore may be any size relative to the area of the roof portion. In embodiments, the bore has a minimum diameter which is at least 20%, 30%, 40%, 50%, 60%, 70%, 80%, 90% or 95% of the minimum diameter of the roof portion. In embodiments, the bore has a minimum diameter which is no more than 95%, 90%, 80%, 70%, 60%, 50%, 40% or 30% of the minimum diameter of the roof portion. In embodiments, the minimum diameter of the bore is 20-100% or 40-90% of the minimum diameter of the roof portion. Preferably, the diameter of the bore is less than the diameter of the roof portion, such that some amount of roof portion is present around the entire periphery of the bore, for manufacturing purposes. However, it will be understood that in some embodiments the minimum diameter of the bore may be 100% of the minimum diameter of the roof portion, such that the roof portion consists entirely of the bore.

In embodiments where the second end of the feeder sleeve comprises a chamfered portion, the chamfered portion may extend from the sidewall at an angle of at least 10°, 20°, 30°, 40°, 50° or 60° relative to the longitudinal axis of the feeder sleeve. The chamfered portion may extend from the sidewall at an angle of no more than 70°, 60°, 50°, 40°, 30° or 20° relative to the longitudinal axis of the feeder sleeve. In embodiments, the chamfered portion extends from the sidewall at an angle of 10-70°, 20-60° or 30-50° relative to the longitudinal axis of the feeder sleeve. The chamfered portion may extend for a minimum distance, as measured between the sidewall and the roof portion, which is at least 10%, 20%, 30%, 50%, 75%, 100% or 125% of the minimum diameter of the sidewall. The chamfered portion may extend for a minimum distance which is no more than 150%, 125%, 100%, 75%, 50%, 30% or 20% of the minimum diameter of the sidewall. In embodiments, the chamfered portion extends for a minimum distance which is 10-150%, 20-100%, or 20-50% of the minimum diameter of the sidewall.

In embodiments where the second end of the feeder sleeve comprises a curved portion, the radius of curvature of the curved portion may be at least 2 mm, 5 mm, 10 mm, 20 mm, 30 mm, 50 mm, 75 mm or 90 mm. The radius of curvature of the curved portion may be no more than 100 mm, 90 mm, 75 mm, 50 mm, 30 mm, 20 mm, 10 mm or 5 mm. In embodiments, the radius of curvature of the curved portion is 2-100 mm, 5-75 mm or 10-50 mm. It will be understood that the exact radius of curvature will depend on the overall dimensions of the feeder sleeve, and may be larger than these values if the feeder is exceptionally large.

In embodiments, the feeder sleeve may comprise two or more parts which are fitted together by any suitable means (e.g. adhesive, tongue-and-groove, etc.). One of the parts may comprise the roof portion and the curved or chamfered portion, while another one of the parts may comprise the base portion of the feeder sleeve.

According to a second aspect of the present invention, there is provided a feeder system for metal casting, the feeder system comprising a feeder sleeve mounted on a breaker core. The feeder sleeve has a first end and an opposite second end, a longitudinal axis extending between the first and second ends, and a continuous sidewall extending generally around the longitudinal axis between the first and second ends. The sidewall of the feeder sleeve defines a cavity for receiving molten metal during casting. The first end of the feeder sleeve comprises a base portion which is mounted on the breaker core. The breaker core comprises a planar base defining a bore therethrough, and an annular raised sidewall extending around the circumference of the planar base. The raised sidewall has a lower surface, which is attached to or integrally formed with the planar base, and an upper surface opposite to the lower surface. The breaker core further comprises a ridge or boss projecting from the upper surface of the raised sidewall in a direction away from the planar base, which is configured to engage with the base portion of the feeder sleeve.

As discussed above in relation to the first aspect, providing a breaker core with a raised sidewall enables the feeder sleeve to be assembled on the breaker core after the first plastic film has been drawn over the mould pattern, preventing the creation of plastic film bridges between adjacent feeder sleeves.

In embodiments, the second end of the feeder sleeve comprises a planar roof portion and a curved or chamfered portion extending around the periphery of the roof portion, for connecting the sidewall and the roof portion of the feeder sleeve. Alternatively, the second end of the feeder sleeve may comprise only a planar roof portion, connected directly to the sidewall at a 90° angle.

The invention also resides in a feeder sleeve and a breaker core for use in the feeder system according to embodiments of the first and second aspects.

According to a third aspect of the invention, there is provided a feeder sleeve for use in metal casting, the feeder sleeve comprising a first end and an opposite second end, a longitudinal axis extending between the first and second ends, and a continuous sidewall extending generally around the longitudinal axis between the first and second ends, the sidewall defining a cavity for receiving molten metal during casting, the first end of the feeder sleeve being configured for mounting on a breaker core, and the second end of the feeder sleeve comprising a planar roof portion and a curved or chamfered portion extending around the periphery of the roof portion, for connecting the sidewall and the roof portion of the feeder sleeve.

According to a fourth aspect of the invention, there is provided a breaker core for use in metal casting, the breaker core comprising a planar base defining a bore therethrough and an annular raised sidewall extending around the circumference of the planar base, the raised sidewall comprising a lower surface, which is attached to or integrally formed with the planar base, and an upper surface opposite to the lower surface, the breaker core further comprising a ridge or boss projecting from the upper surface of the raised sidewall in a direction away from the planar base, the ridge or boss being configured to engage with the base portion of a feeder sleeve.

The features described above in relation to embodiments of the first aspect may apply equally to embodiments of the second, third and fourth aspects. All combinations of the aspects of the present invention are considered, except where there is any technical incompatibility.

BRIEF DESCRIPTION OF THE DRAWINGS

Embodiments of the invention will now be described by way of example only with reference to the accompanying drawings in which.

DETAILED DESCRIPTION OF THE PREFERRED EMBODIMENTS

Figure 2:
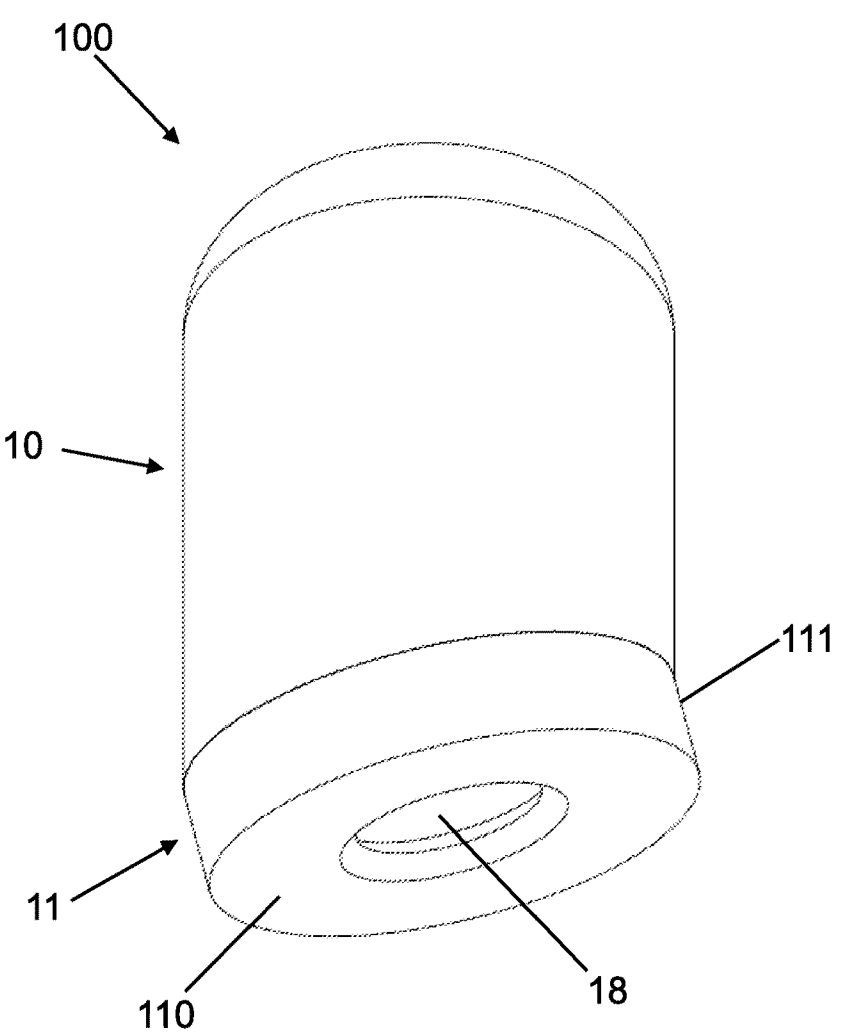
FIGS. 1-3 are schematic views of a feeder system according to an embodiment of the present invention.
Figure 1:
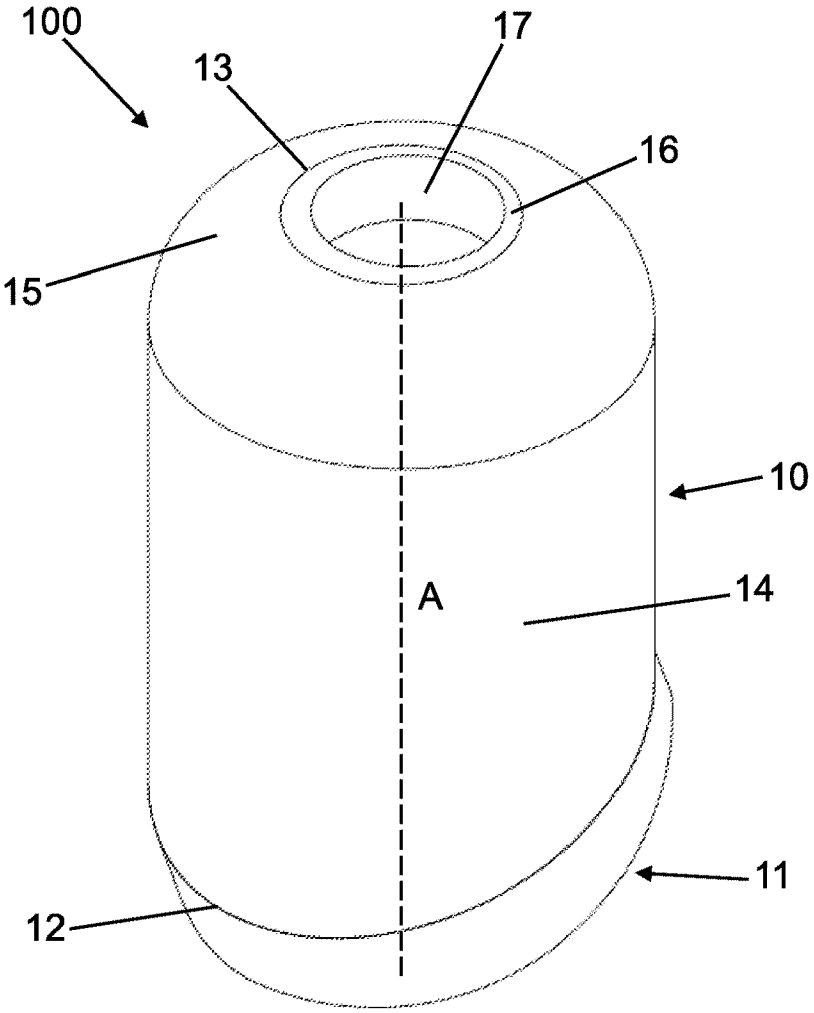
Figure 4:
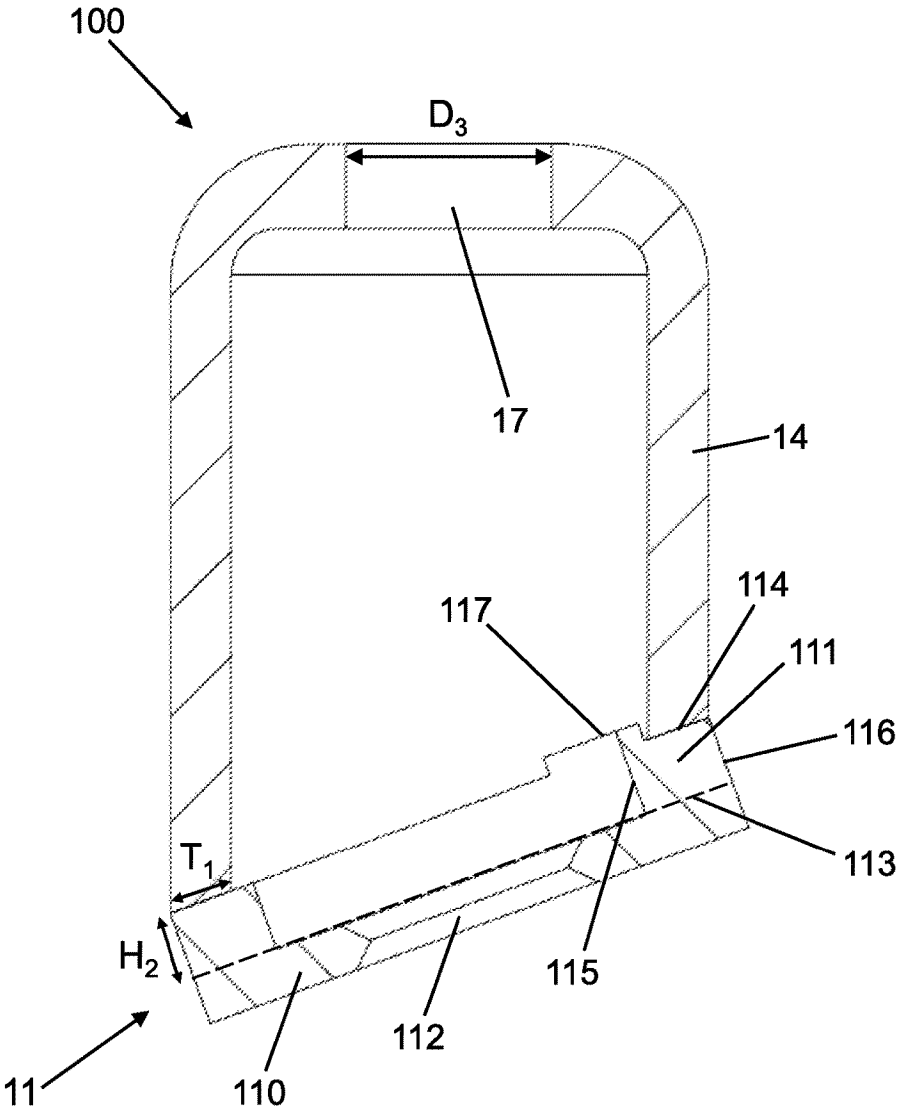
FIG. 4 is a cross-sectional view of the feeder system shown in FIGS. 1-3.
Figure 3:
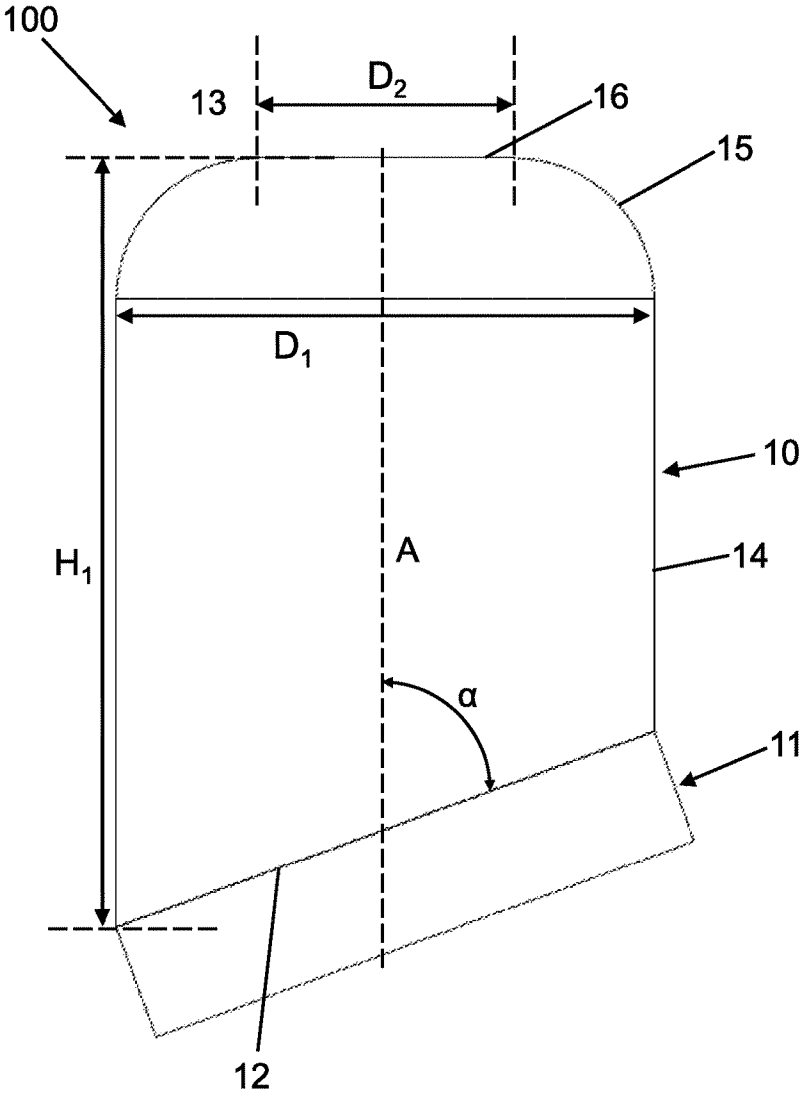
Figure 6:
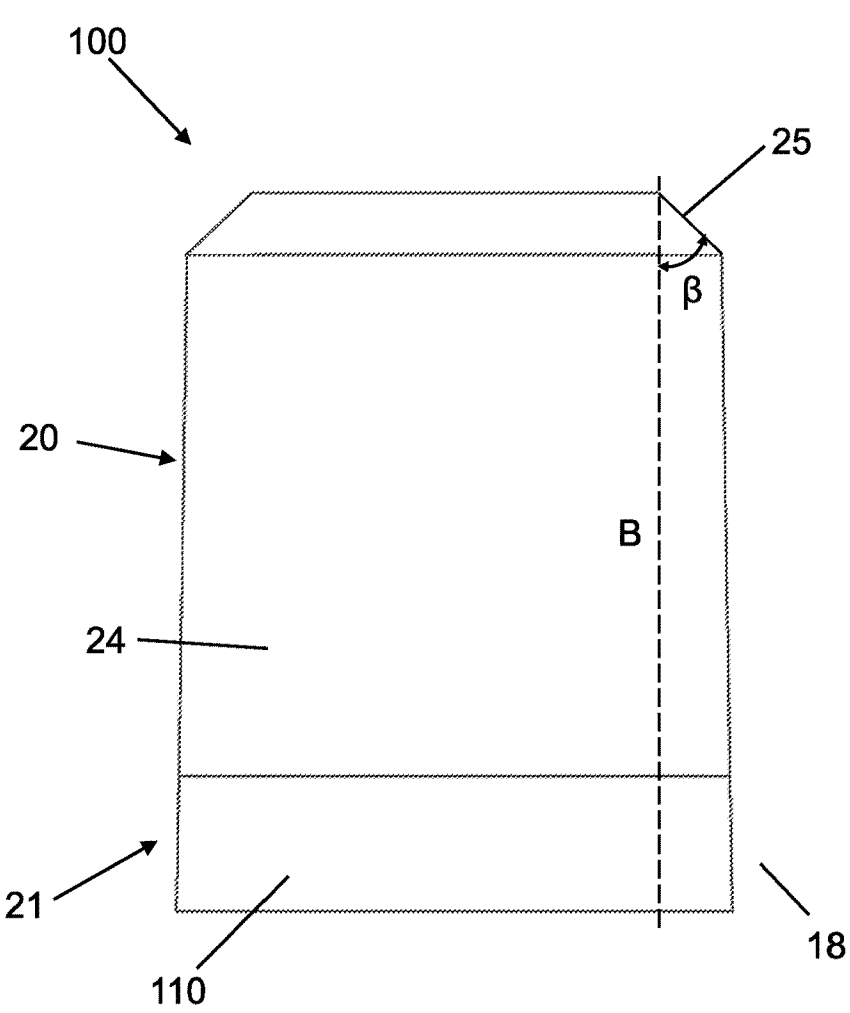
FIGS. 5-7 are schematic views of a feeder system according to a different embodiment of the present invention.
Figure 5:
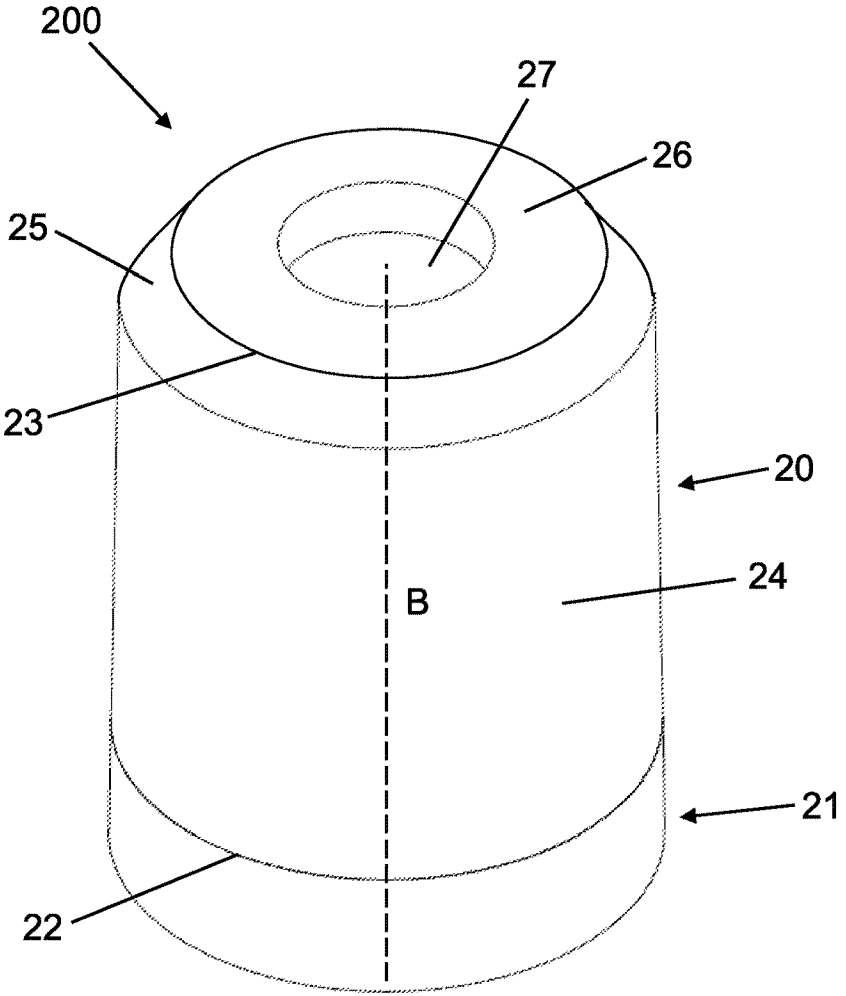
Figure 8:
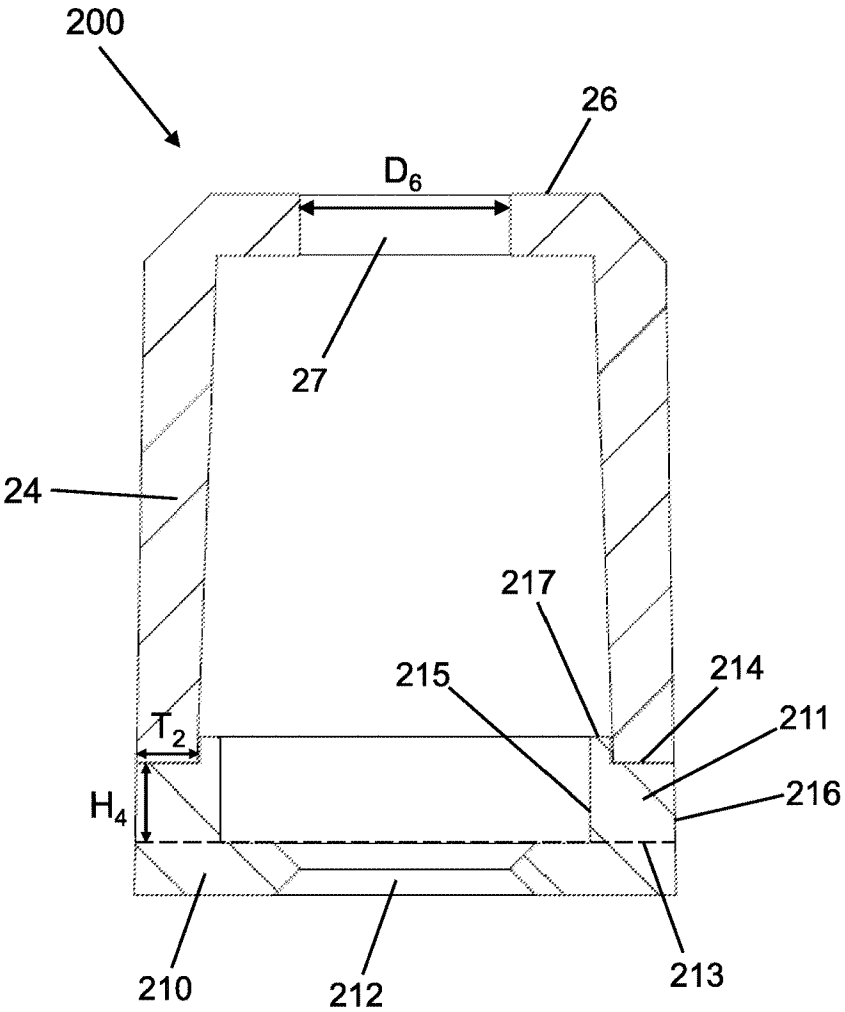
FIG. 8 is a cross-sectional view of the feeder system shown in FIGS. 5-7.
Figure 7:
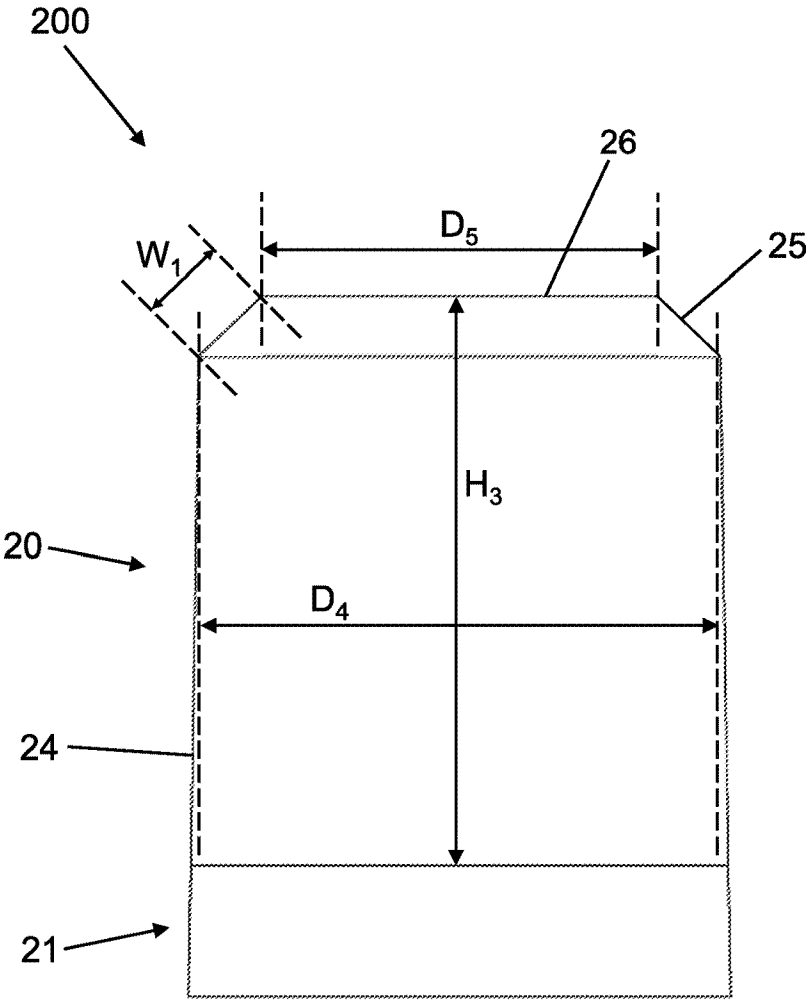

Referring to FIGS. 1-4, there is shown a feeder system 100 comprising a feeder sleeve 10 mounted on a breaker core 11. The feeder sleeve 10 has a first end 12 and an opposite second end 13, with a longitudinal axis A extending between the first and second ends 12,13. A continuous sidewall 14 extends generally around the longitudinal axis A in the shape of a cylinder, defining a cavity therein for receiving molten metal. The diameter $D_1$ of the sidewall 14 is constant from the first end 12 of the feeder sleeve 10 to the second end 13.

The second end 13 of the feeder sleeve 10 comprises a centrally located, planar roof portion 16 which extends perpendicular to the longitudinal axis A. The second end 13 also comprises a curved portion 15 connecting the sidewall 14 and the roof portion 16 of the feeder sleeve. The radius of curvature of the curved portion 15 is 28.5 mm. The roof portion 16 is circular and has a centrally located bore 17 extending therethrough, which is also generally circular in cross-section. The diameter $D_2$ of the roof portion 16 is 50% of the diameter $D_1$ of the sidewall of the feeder sleeve, and the diameter $D_3$ of the bore 17 is less than the diameter $D_2$ of the roof portion 16, such that a part of the roof portion 16 extends around the entire periphery of the bore 17.

The first end 12 of the feeder sleeve 10 is mounted on the breaker core 11, and is inclined at an angle $\alpha$ of 70° relative to the longitudinal axis, such that the sidewall 14 is shorter on one side of the feeder sleeve 10 than on the opposite side. The breaker core 11 comprises a planar base 110 and a raised sidewall 111 extending around the circumference of the planar base 110 (best seen in FIG. 4). The planar base 110 is generally circular and comprises a centrally located bore 112 extending therethrough. The raised sidewall 111 has a lower surface 113 which is in communication and integrally formed with the planar base 110, and an upper surface 114 opposite to the planar base 110, with an inner edge 115 and an oppositely disposed outer edge 116 extending between the lower and upper surfaces 113, 114. The height $H_2$ of the raised sidewall 111, as measured from the lower surface 113 to the upper surface 114, is 6.25%% of the maximum height $H_1$ of the feeder sleeve 10, as measured from the first end 12 to the second end 13 where the height of the sidewall 14 is greatest.

The breaker core 11 further comprises a boss 117 projecting from the inner edge side of the upper surface 114 of the raised sidewall 111. The boss 117 extends around 25% of the circumference of the inner edge 115. The base of the sidewall 14 of the feeder sleeve 10 has a thickness $T_1$ which corresponds to the remaining area of the upper surface 114 of the raised sidewall 111 excluding the boss 117, such that the base of the sidewall 14 abuts against the boss 117.

Referring to FIGS. 5-8, there is shown another embodiment of a feeder system 200 according to the present invention. The feeder system 200 comprises a feeder sleeve 20 mounted on a breaker core 21. The feeder sleeve 20 has a first end 22 and an opposite second end 23, with a longitudinal axis B extending between the first and second ends 22,23. A continuous sidewall 24 extends generally around the longitudinal axis B, generally in the shape of a cylinder defining a cavity therein for receiving molten metal. The diameter of the sidewall 24 is slightly smaller at the second end 23 of the feeder sleeve 20 than at the first end 22, such that the sidewall 24 has a minimum diameter $D_4$ at the second end 23 of the feeder sleeve.

The second end 23 of the feeder sleeve 20 comprises a centrally located, planar roof portion 26 which extends perpendicular to the longitudinal axis B. The second end 23 also comprises a chamfered portion 25 connecting the sidewall 24 and the roof portion 26 of the feeder sleeve. The chamfered portion 25 is inclined at an angle $\beta$ of 50° relative to the longitudinal axis B and extends for a distance $W_1$ equal to 24% of the minimum diameter $D_4$ of the sidewall 24. The roof portion 26 is circular and has a centrally located bore 27 extending therethrough, which is also generally circular in cross-section. The diameter $D_5$ of the roof portion 26 is 63% of the minimum diameter $D_4$ of the sidewall of the feeder sleeve, and the diameter $D_6$ of the bore 27 is less than the diameter $D_5$ of the roof portion 26, such that a part of the roof portion 26 extends around the entire periphery of the bore 27.

The first end 22 of the feeder sleeve 20 is mounted on the breaker core 21. The first end 22 of the feeder sleeve 20 extends perpendicular to the longitudinal axis B, such that the sidewall 24 has a uniform height. The breaker core 21 comprises a planar base 210 and a raised sidewall 211 extending around the circumference of the planar base 210 (best seen in FIG. 8). The planar base 210 is generally circular and comprises a centrally located bore 212 extending therethrough. The raised sidewall 211 has a lower surface 213 which is in communication and integrally formed with the planar base 210, and an upper surface 214 opposite to the planar base 210, with an inner edge 215 and an oppositely disposed outer edge 216 extending between the lower and upper surfaces 213, 214. The height $H_4$ of the raised sidewall 211, as measured from the lower surface 213 to the upper surface 214, is 6% of the height $H_3$ of the feeder sleeve 20, as measured from the first end 22 to the second end 23.

The breaker core 21 further comprises a boss 217 projecting from the inner edge side of the upper surface 214 of the raised sidewall 211. The boss 217 extends around the entire circumference of the inner edge 215. The base of the sidewall 24 of the feeder sleeve 20 has a thickness $T_2$ which corresponds to the remaining area of the upper surface 214 of the raised sidewall 211 excluding the boss 217, such that the base of the sidewall 24 abuts against the boss 217.

Figure 10:
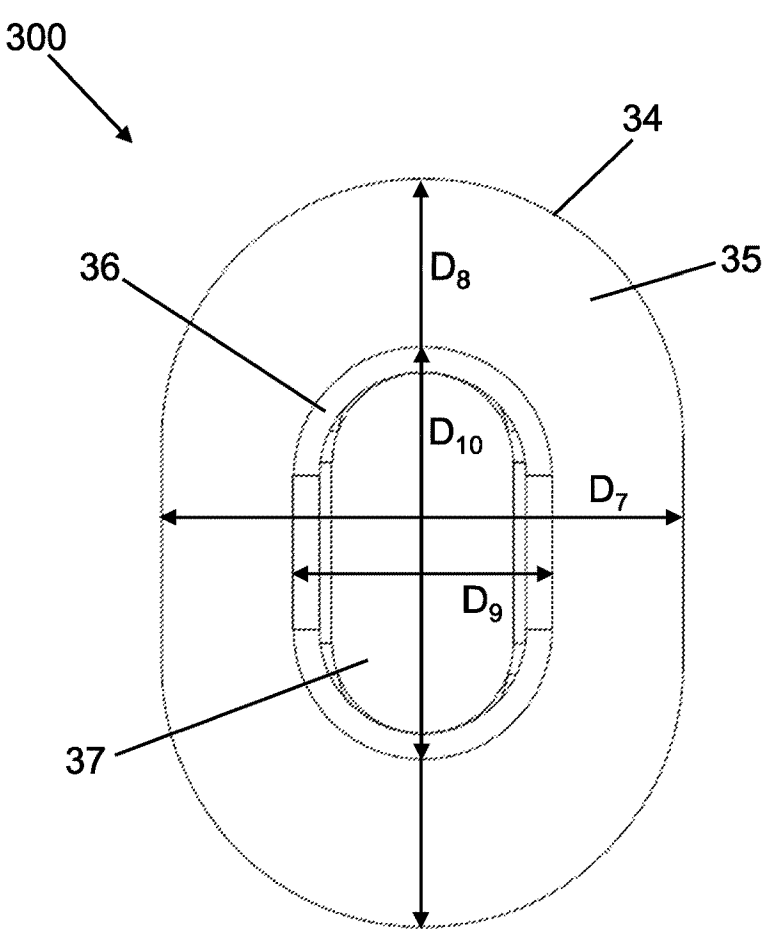
FIG. 10 is a plan view of the feeder system shown in FIG. 9.
Figure 9:
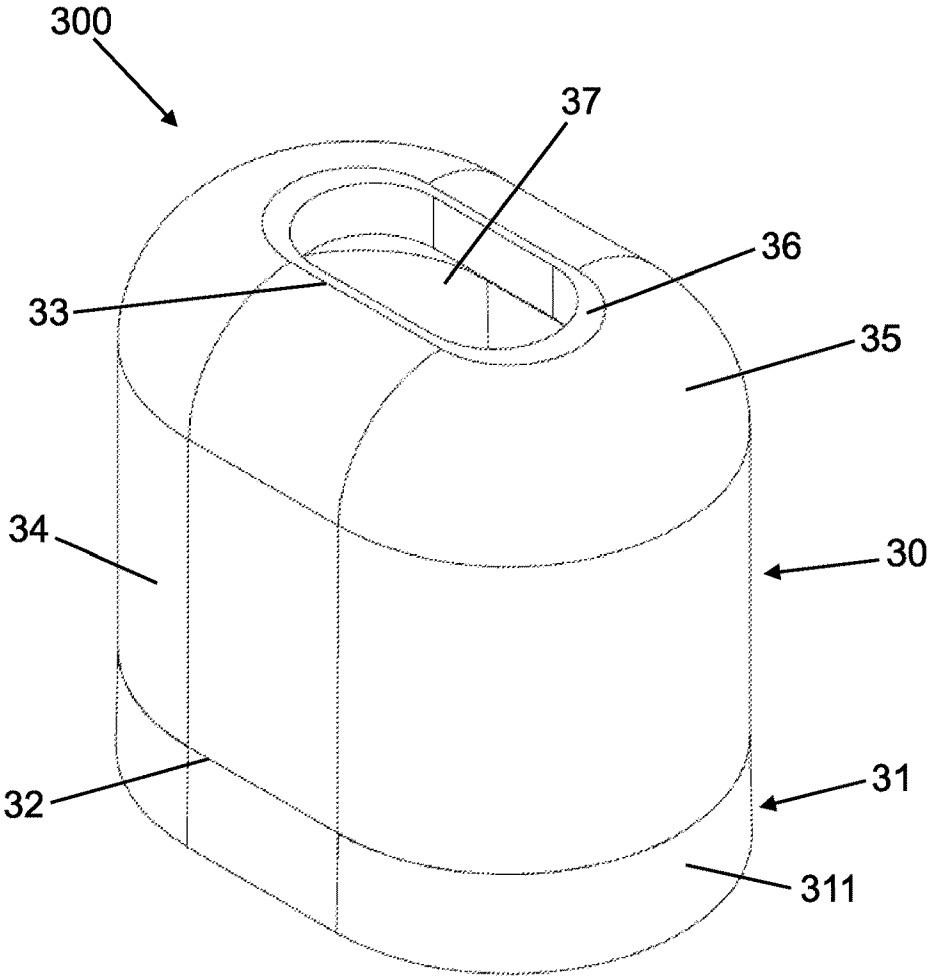
FIG. 9 is a schematic view of a feeder system in accordance with a further embodiment of the present invention.

Referring to FIGS. 9-10, there is shown a further embodiment of a feeder system 300 according to the present invention. The feeder system 300 comprises a feeder sleeve 30 mounted on a breaker core 31. The feeder sleeve 30 has a first end 32 and an opposite second end 33, with a longitudinal axis (not shown) extending between the first and second ends 32,33. A continuous sidewall 34 extends generally around the longitudinal axis with an obround cross-sectional shape, defining a cavity therein for receiving molten metal.

The first end 32 of the feeder sleeve 30 is mounted on the breaker core 31. The first end 32 of the feeder sleeve 30 extends perpendicular to the longitudinal axis, such that the sidewall 34 has a uniform height. The breaker core 31 comprises a planar base (not shown) and a raised sidewall 311 extending around the circumference of the planar base. The planar base is generally obround and comprises a centrally located bore extending therethrough (not shown).

The second end 33 of the feeder sleeve 30 comprises a centrally located, planar roof portion 36 which extends perpendicular to the longitudinal axis. The second end 33 also comprises a curved portion 35 connecting the sidewall 34 and the roof portion 36 of the feeder sleeve 30. The roof portion 36 is obround and has a centrally located bore 37 extending therethrough, which is also obround in cross-section.

As shown in FIG. 10, the sidewall 34 has a minimum diameter $D_7$ between the long sides of the obround cross-section and a maximum diameter $D_8$ between the short sides of the obround cross-section. The obround roof portion 36 also has a minimum diameter $D_9$ between the long sides and a maximum diameter $D_{10}$ between the short sides. The minimum $D_9$ diameter of the roof portion 36 is around 40% of the minimum diameter $D_7$ of the sidewall 34. The diameter of the bore 37 is less than the diameter of the roof portion 36, such that part of the roof portion 36 extends around the entire periphery of the bore 37.

Figure 11:
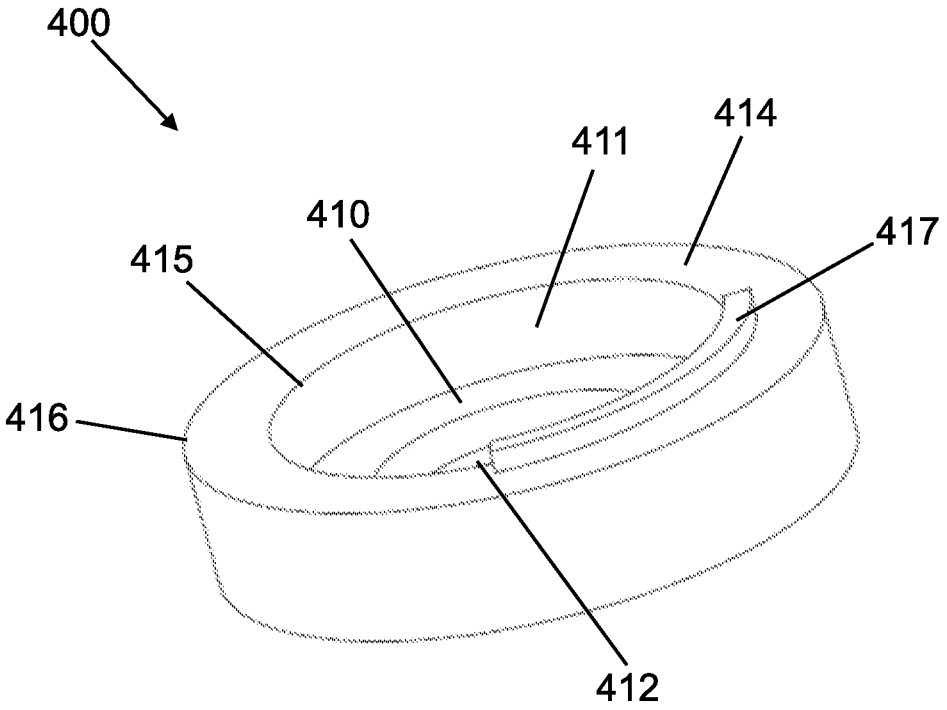
FIG. 11 is a schematic view of an embodiment of a breaker core for use with embodiments of the feeder system of the invention.

Referring to FIG. 11, there is shown an embodiment of a breaker core 400 for use in a feeder system according to embodiments of the present invention. The breaker core 400 comprises a planar base 410 and a raised sidewall 411 extending around the circumference of the planar base 410. The planar base 410 is generally circular and comprises a centrally located bore 412 extending therethrough. The raised sidewall 411 has a lower surface (not shown) which is in communication and integrally formed with the planar base 410, and an upper surface 414 opposite to the planar base 410, with an inner edge 415 and an oppositely disposed outer edge 416 extending between the lower and upper surfaces 413, 414. The breaker core 400 further comprises a boss 417 projecting from the inner edge side of the upper surface 414 of the raised sidewall 411. The boss 417 extends around approximately 25% of the circumference of the inner edge 215.

Figure 12:
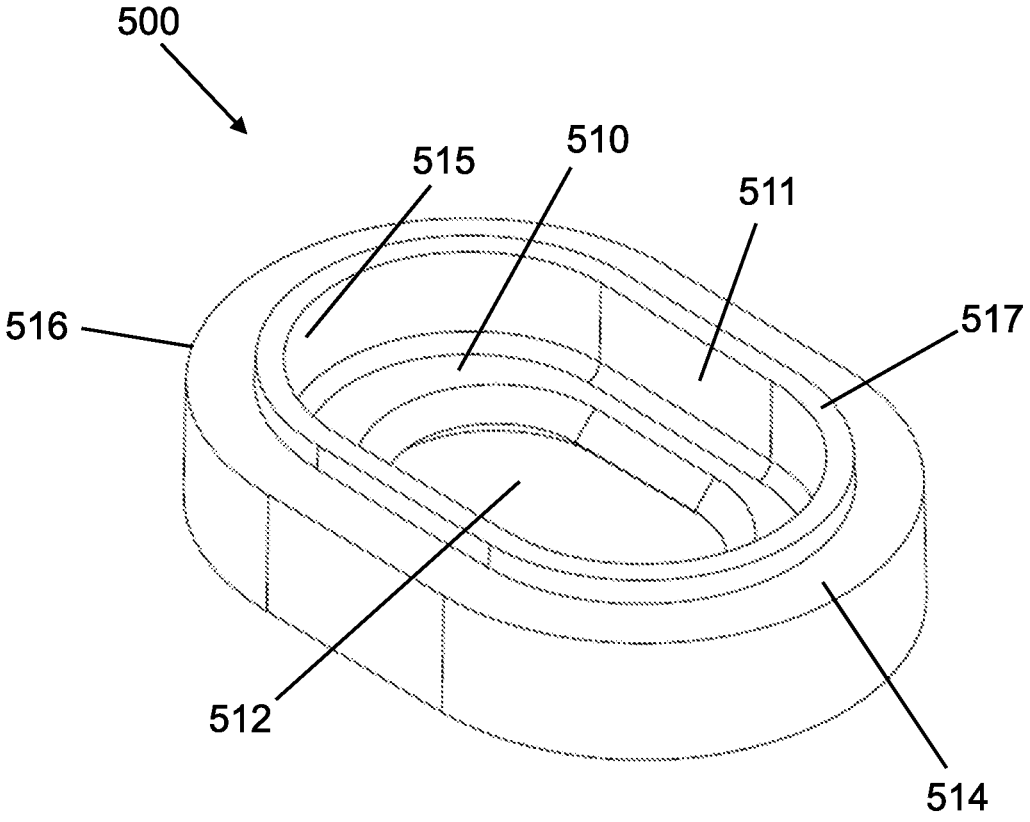
FIG. 12 is a schematic view of another embodiment of a breaker core for use with embodiments of the feeder system of the invention.

Referring to FIG. 12, there is shown another embodiment of a breaker core 500 for use in a feeder system according to embodiments of the present invention. The breaker core 500 comprises substantially the same features as the breaker core 400 shown in FIG. 11, except that the planar base 510 is obround rather than circular and the boss 517 extends around the entire circumference of the inner edge side of the upper surface 514. The bore 512 extending through the planar base 510 is also obround in cross-section.

The invention claimed is:

1. A feeder system for metal casting, the feeder system comprising a feeder sleeve mounted on a breaker core, the feeder sleeve having a first end and an opposite second end, a longitudinal axis extending between the first and second ends, and a continuous sidewall extending generally around the longitudinal axis between the first and second ends, the sidewall defining a cavity for receiving molten metal during casting, and the breaker core defining an open bore therethrough for connecting the cavity to the casting, wherein the first end of the feeder sleeve comprises a base portion which is mounted on the breaker core, and the second end of the feeder sleeve comprises a planar roof portion and a curved or chamfered portion extending around a periphery of the roof portion, for connecting the sidewall and the roof portion, wherein the minimum diameter of the roof portion is 25-90% of the minimum diameter of the sidewall of the feeder sleeve.

2. The feeder system of claim 1, wherein the sidewall of the feeder sleeve is cylindrical and the cross-sectional shape of the cylinder is generally circular, oval or obround.

3. The feeder system of claim 1, wherein the base portion and the breaker core extend at an angle of 2-100° relative to the longitudinal axis of the feeder sleeve.

4. The feeder system of claim 1, wherein the base portion and the breaker core extend perpendicular to the longitudinal axis of the feeder sleeve.

5. The feeder system of claim 1, wherein the breaker core comprises a planar base and a raised sidewall extending around the circumference of the planar base.

6. The feeder system of claim 5, wherein the height of the raised sidewall is 1-15% of the height of the feeder sleeve.

7. The feeder system of claim 5, wherein the breaker core further comprises a boss projecting from an upper surface of the raised sidewall.

8. The feeder system of claim 7, wherein the boss projects partially or completely around the circumference of an inner edge of the raised sidewall.

9. The feeder system of claim 1, wherein the roof portion comprises an open bore therethrough.

10. The feeder system of claim 9, wherein the minimum diameter of the bore extending through the roof portion is 20-100% of the minimum diameter of the roof portion.

11. The feeder system of claim 1, wherein the second end of the feeder sleeve comprises a chamfered portion and the chamfered portion extends at an angle of 10-70° relative to the longitudinal axis of the feeder system.

12. The feeder system of claim 1, wherein the second end of the feeder sleeve comprises a chamfered portion and the width of the chamfered portion, as measured between the sidewall and the roof portion, is 10-150% of the minimum diameter of the sidewall.

13. The feeder system of claim 1, wherein the second end of the feeder sleeve comprises a curved portion and the radius of curvature of the curved portion is 2-100 mm.

14. The feeder system of claim 1, wherein the sidewall of the feeder sleeve comprises two or more parts which are fitted together, wherein one of the parts comprises the roof portion and the curved or chamfered portion, and wherein another one of the parts comprises the base portion.

* * * * *